US007946349B2

(12) United States Patent
Kriesels

(10) Patent No.: US 7,946,349 B2
(45) Date of Patent: May 24, 2011

(54) METHOD OF RADIALLY EXPANDING A TUBULAR ELEMENT

(75) Inventor: Petrus Cornelis Kriesels, Rijswijk (NL)

(73) Assignee: Shell Oil Company, Houston, TX (US)

( * ) Notice: Subject to any disclaimer, the term of this patent is extended or adjusted under 35 U.S.C. 154(b) by 120 days.

(21) Appl. No.: 12/373,435

(22) PCT Filed: Jul. 11, 2007

(86) PCT No.: PCT/EP2007/057068

§ 371 (c)(1),
(2), (4) Date: Jan. 12, 2009

(87) PCT Pub. No.: WO2008/006841

PCT Pub. Date: Jan. 17, 2008

(65) Prior Publication Data

US 2009/0288842 A1 Nov. 26, 2009

(30) Foreign Application Priority Data

Jul. 13, 2006 (EP) ..... 06117170

(51) Int. Cl.
*E21B 19/00* (2006.01)

(52) U.S. Cl. ..... 166/384; 405/150.1

(58) Field of Classification Search ..... 166/384, 166/242.2, 207; 405/150.1, 184, 165, 146; 175/171, 78, 52
See application file for complete search history.

(56) References Cited

U.S. PATENT DOCUMENTS

| | | | | |
|---|---|---|---|---|
| 5,169,264 A | | 12/1992 | Kimura | 405/184 |
| 5,309,994 A | * | 5/1994 | Douglas et al. | 166/278 |
| 5,634,743 A | * | 6/1997 | Chandler | 405/150.1 |
| 5,993,114 A | | 11/1999 | Jones | 405/150.1 |
| 6,109,828 A | | 8/2000 | Keller | 405/146 |
| 6,446,670 B1 | | 9/2002 | Woodward et al. | 138/98 |
| 6,932,116 B2 | * | 8/2005 | Smith et al. | 138/98 |
| 6,953,307 B2 | | 10/2005 | Graham | 405/184.1 |
| 7,281,422 B2 | | 10/2007 | Keller | 73/152.41 |
| 7,387,174 B2 | | 6/2008 | Lurie | 175/57 |
| 2007/0017669 A1 | | 1/2007 | Lurie | 166/177.4 |

FOREIGN PATENT DOCUMENTS

| | | |
|---|---|---|
| DE | 1189492 | 3/1965 |
| EP | 44706 | 1/1982 |
| EP | 1438483 | 7/2004 |
| WO | WO9947340 | 9/1999 |
| WO | WO2005024178 | 3/2005 |

OTHER PUBLICATIONS

International Search Report dated Oct. 10, 2007 (PCT/EP2007/057068).

* cited by examiner

*Primary Examiner* — Shane Bomar
*Assistant Examiner* — Kipp C Wallace

(57) ABSTRACT

A method of radially expanding a tubular element comprises inducing the wall of the tubular element to bend radially outward and in an axially reverse direction so as to form an expanded tubular section extending around an unexpanded section of the tubular element. The bending process occurs in a bending zone of the tubular element, and the method further comprises progressively increasing the length of the expanded tubular section by inducing the bending zone to move in an axial direction along the tubular element.

18 Claims, 4 Drawing Sheets

METHOD OF RADIALLY EXPANDING A TUBULAR ELEMENT

The present application claims priority from PCT/EP2007/057068, filed 11 Jul. 2007, which claims priority from European Patent Application 06117170.8 filed 13 Jul. 2006.

FIELD OF THE INVENTION

The present invention relates to a method of radially expanding a tubular element.

BACKGROUND OF THE INVENTION

Expansion of tubular elements finds application in various fields of technology such as, for example the industry of oil and gas production from a wellbore formed in an earth formation. Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall, whereby it is generally understood that a casing extends from surface into the wellbore and that a liner extends from a downhole location further into the wellbore. However, in the present context, the terms "casing" and "liner" are used interchangeably and without such intended distinction.

In conventional wellbore construction, several casings are set at different depth intervals, in a nested arrangement, whereby each subsequent casing is lowered through the previous casing and therefore must have a smaller diameter than the previous casing. As a result, the cross-sectional wellbore size available for oil and gas production decreases with depth. To alleviate this drawback, it has become practice to radially expand tubular elements in the wellbore after lowering to the required depth, for example to form an expanded casing or liner section or a clad against an existing casing. Also, it has been proposed to radially expand each subsequent casing to substantially the same diameter as the previous casing to form a monobore wellbore. It is thus achieved that the available diameter of the wellbore is kept substantially constant along (a portion of) its depth as opposed to the conventional nested arrangement.

EP 1438483 B1 discloses a method of radially expanding a tubular element in a wellbore whereby the tubular element, in unexpanded state, is initially attached to a drill string during drilling of a new wellbore section. Thereafter the tubular element is radially expanded and released from the drill string.

To expand such wellbore tubular element, generally a conical expander is used with a largest outer diameter substantially equal to the required tubular diameter after expansion. The expander is pumped, pushed or pulled through the tubular element. Such method can lead to high friction forces that need to be overcome, between the expander and the inner surface of the tubular element. Also, there is a risk that the expander becomes stuck in the tubular element.

EP 0044706 A2 discloses a method of radially expanding a flexible tube of woven material or cloth by eversion thereof in a wellbore, to separate drilling fluid pumped into the wellbore from slurry cuttings flowing towards the surface.

Although in some applications the known expansion techniques have indicated promising results, there is a need for an improved method of radially expanding a tubular element.

SUMMARY OF THE INVENTION

In accordance with the invention there is provided a method of radially expanding a tubular element extending into a wellbore formed in an earth formation, the method comprising inducing the wall of the tubular element to bend radially outward and in axially reverse direction so as to form an expanded tubular section extending around a remaining tubular section of the tubular element, wherein said bending occurs in a bending zone of the tubular element, and wherein the method further comprises increasing the length of the expanded tubular section by inducing the bending zone to move in axial direction relative to the remaining tubular section, and wherein said wall includes a material that is plastically deformed in the bending zone during the bending process so that the expanded tubular section retains an expanded shape as a result of said plastic deformation.

Thus, the tubular element is effectively turned inside out during the bending process. The bending zone defines the location where the bending process takes place. By inducing the bending zone to move in axial direction along the tubular element it is achieved that the tubular element is progressively expanded without the need for an expander that has to be pushed, pulled or pumped through the tubular element. Furthermore the expanded tubular section retains its shape due to plastic deformation, that is permanent deformation, of the wall. It is thereby achieved that the expanded tubular section automatically maintains its expanded shape, that is, no external force or pressure needs to be exerted to the expanded tubular section to maintain its expanded shape. If, for example, the expanded tubular section has been expanded against the wellbore wall as a result of said bending of the wall, no external radial force or pressure needs to be exerted to the expanded tubular section to keep it against the wellbore wall. Suitably the wall of the tubular element is made of a metal such as steel or any other ductile metal capable of being plastically deformed by eversion of the tubular element. The expanded tubular section then has adequate collapse resistance, for example in the order of 100-150 bars. If the tubular element extends vertically in the wellbore, the weight of the remaining tubular section can be utilised to contribute to the force needed to induce downward movement of the bending zone.

Suitably the bending zone is induced to move in axial direction relative to the remaining tubular section by inducing the remaining tubular section to move in axial direction relative to the expanded tubular section. For example, the expanded tubular section is held stationary while the remaining tubular section is moved in axial direction through the expanded tubular section to induce said bending of the wall.

In order to induce said movement of the remaining tubular section, preferably the remaining tubular section is subjected to an axially compressive force acting to induce said movement. The axially compressive force preferably at least partly results from the weight of the remaining tubular section. If necessary the weight can be supplemented by an external, downward, force applied to the remaining tubular section to induce said movement. As the length, and hence the weight, of the remaining tubular section increases, an upward force may need to be applied to the remaining tubular section to prevent uncontrolled bending or buckling in the bending zone.

If the bending zone is located at a lower end of the tubular element, whereby the remaining tubular section is axially shortened at a lower end thereof due to said movement of the bending zone, it is preferred that the remaining tubular section is axially extended at an upper end thereof in correspondence with said axial shortening at the lower end thereof. The remaining tubular section gradually shortens at its lower end due to continued reverse bending of the wall. Therefore, by extending the remaining tubular section at its upper end to compensate for shortening at its lower end, the process of reverse bending the wall can be continued until a desired length of the expanded tubular section is reached. The remaining tubular section can be extended at its upper end, for example, by connecting a tubular portion to said upper end in any suitable manner such as by welding. Alternatively, the remaining tubular section can be provided in the form of a coiled tubing which is unreeled from a reel and gradually inserted into the wellbore. Thus, the coiled tubing is extended at its upper end by unreeling from the reel.

As a result of forming the expanded tubular section around the remaining tubular section, an annular space is formed between the unexpanded and expanded tubular sections. To increase the collapse resistance of the expanded tubular section, a pressurized fluid can be inserted into the annular space. The fluid pressure can result solely from the weight of the fluid column in the annular space, or in addition also from an external pressure applied to the fluid column.

The expansion process is suitably initiated by bending the wall of the tubular element at a lower end portion thereof.

Advantageously the wellbore is being drilled with a drill string extending through the unexpanded tubular section. In such application the unexpanded tubular section and the drill string preferably are lowered simultaneously through the wellbore during drilling with the drill string.

Optionally the bending zone can be heated to promote bending of the tubular wall.

To reduce any buckling tendency of the unexpanded tubular section during the expansion process, the remaining tubular section advantageously is centralised within the expanded section by any suitable centralising means.

Bending of the tubular wall can be promoted by providing longitudinal grooves at the outer surface of the tubular element before expansion.

BRIEF DESCRIPTION OF THE DRAWINGS

The invention will be described hereinafter in more detail and by way of example, with reference to the accompanying drawings in which.

In the Figures and the description like reference numerals relate to like components.

DETAILED DESCRIPTION OF THE INVENTION

Figure 1:
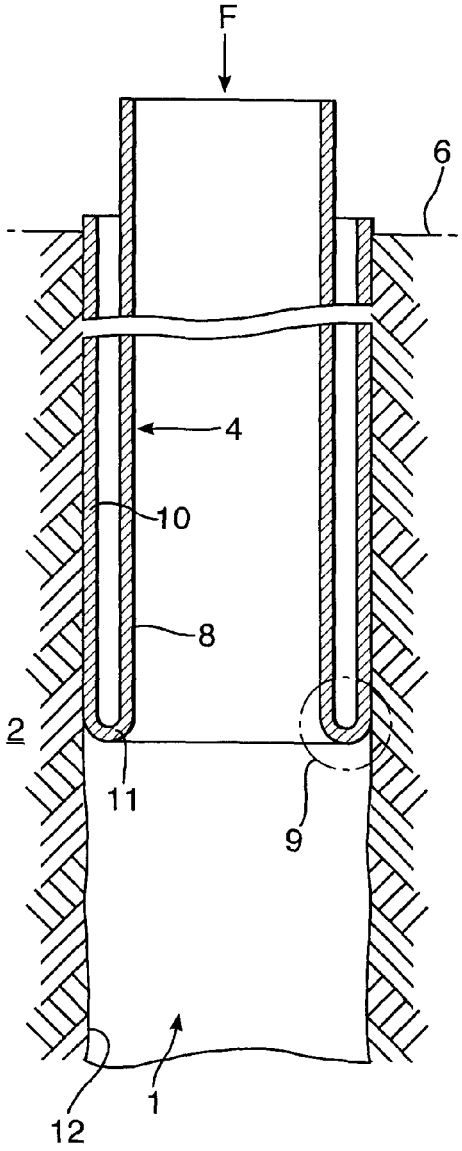
FIG. 1 schematically shows a first embodiment of a system for use with the method of the invention.

Referring to FIG. 1 there is shown a system comprising a wellbore 1 formed into an earth formation 2, and a radially expandable tubular element in the form of expandable steel liner 4 extending from surface 6 downwardly into the wellbore 1. The liner 4 has a radially expanded tubular section 10 and a remaining tubular section in the form of unexpanded section 8 extending within the expanded section 10. The wall of the unexpanded section 8 bends, at its lower end, radially outward and in axially reverse (i.e. upward) direction so as to form a U-shaped lower section 11 interconnecting the unexpanded section 8 and the expanded section 10. The U-shaped lower section 11 defines a bending zone 9 of the tubular element 4. The expanded liner section 10 is axially fixed to the wellbore wall 12 by virtue of frictional forces between the liner section 10 and the wellbore wall 12 as a result of the expansion process. Alternatively, or additionally, the expanded liner section 10 can be anchored to the wellbore wall 12 by any suitable anchoring means (not shown).

Figure 2:
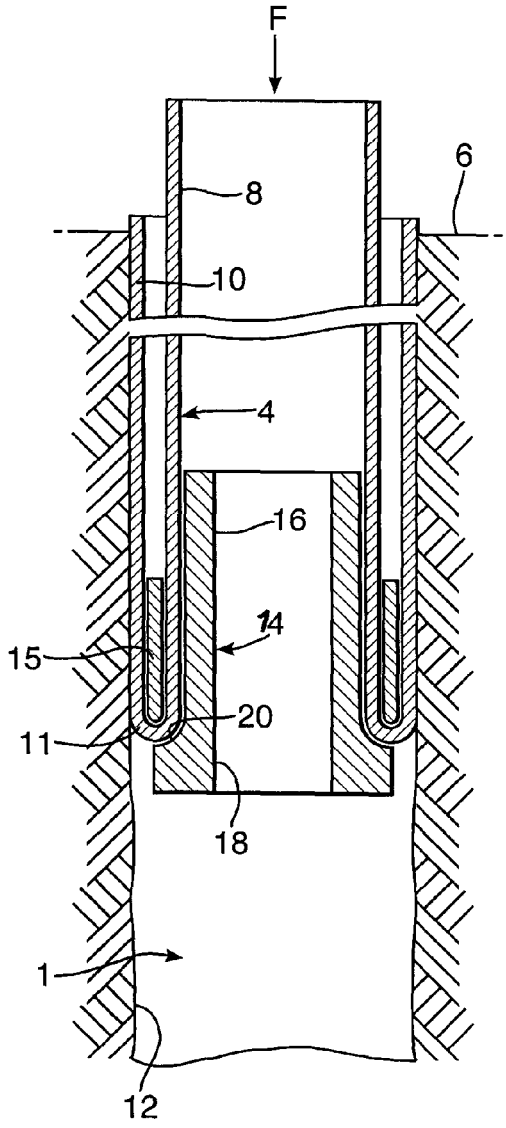
FIG. 2 schematically shows a second embodiment of a system for use with the method of the invention.

The system of FIG. 2 comprises, in addition to the liner 4, a tubular guide member 14 and an auxiliary guide ring 15. The guide member 14 has an upper part 16 extending into the unexpanded liner section 8 and a lower part 18 extending below the U-shaped lower section 11 of the liner 4. The lower part 18 has an external, concave, guide surface 20 extending radially outward and being arranged to guide, and support, the U-shaped lower section 11. The guide member 14 can be suspended from surface by means of a suitable string or cable (not shown) extending through the unexpanded liner section 8. Alternatively, the guide member 14 is simply supported by friction forces between the guide member and the unexpanded liner section 8, or by friction forces between the guide member and the wellbore wall 12. In the latter case the guide member 14 suitably is provided with, for example, brush-like elements that scrape along the wellbore wall 12. The auxiliary guide ring 15 is located between the expanded liner section 10 and the unexpanded liner section 8, and rests on the U-shaped lower section 11.

Figure 3:
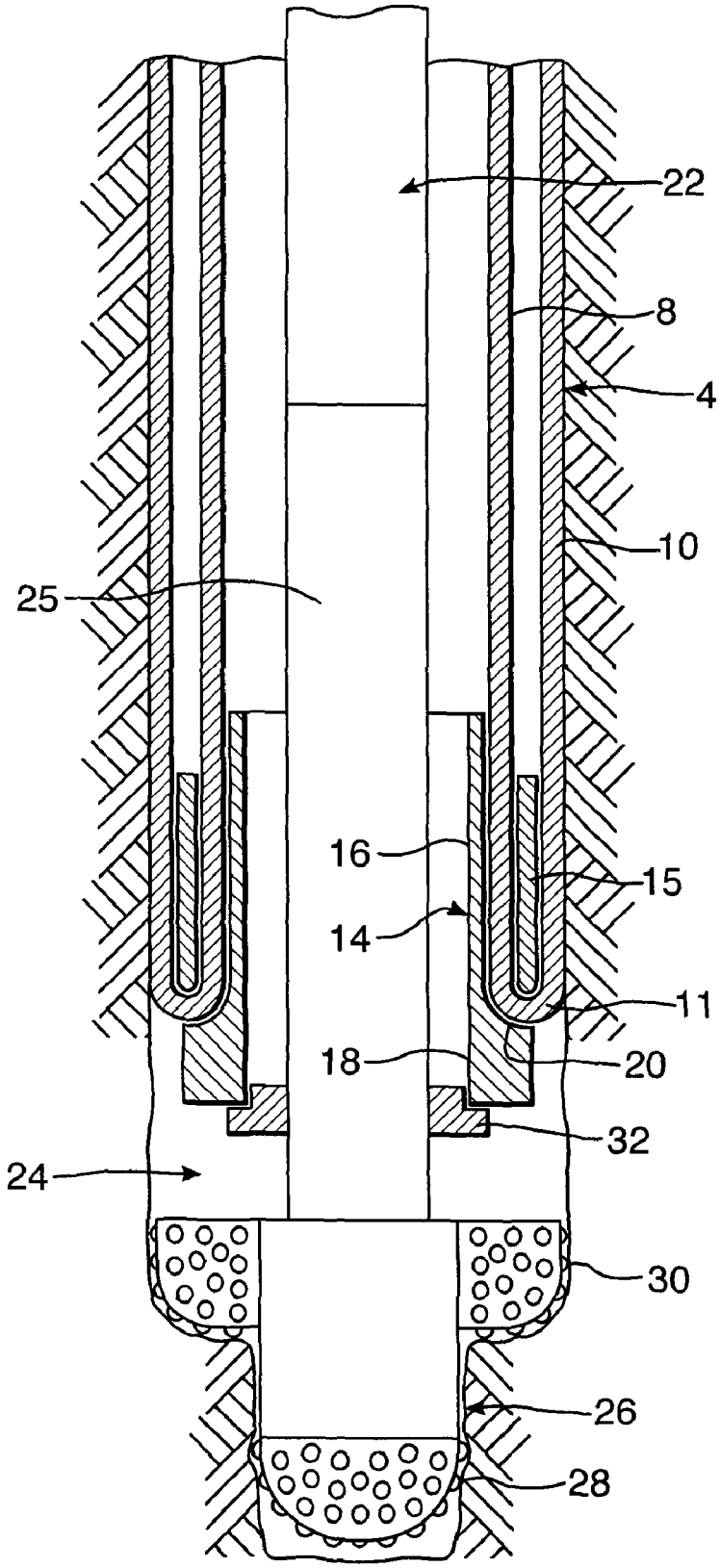
FIG. 3 schematically shows a lower portion of a third embodiment of a system for use with the method of the invention.

The system of FIG. 3 comprises, in addition to the liner 4, the tubular guide member 14 and the auxiliary guide ring 15, a drill string 22 extending from surface through the unexpanded liner section 8 to the bottom of the wellbore 24. The drill string 22 is provided with a support ring 32 to support the guide member 14. The support ring 32 is radially retractable so as to allow it to pass in retracted mode through the guide member 14 and the unexpanded liner section 8. The drill string 22 has a bottom hole assembly including a downhole motor 25 and a drill bit 26 driven by the downhole motor 25. The drill bit 26 comprises a pilot bit 28 with gauge diameter slightly smaller than the internal diameter of the guide member 14, and a reamer section 30 with gauge diameter adapted to drill the wellbore 24 to its nominal diameter. The reamer section 30 is radially retractable to an outer diameter slightly smaller than the internal diameter of the guide member 14 so that the drill bit 26 is capable of passing through the guide member 14 and the unexpanded liner section 8 when the reamer section 30 is in the collapsed mode.

Figure 4:
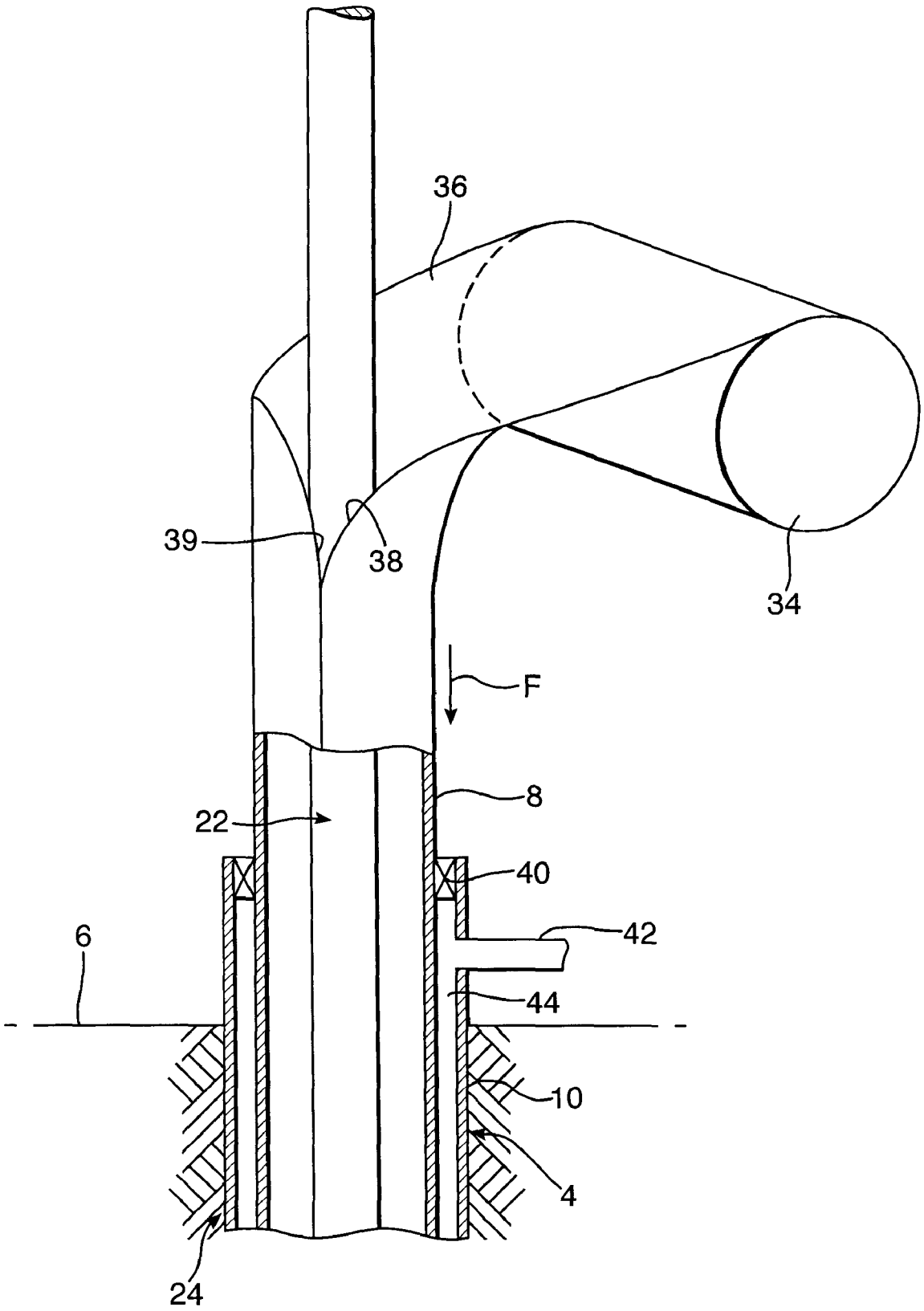
FIG. 4 schematically shows an upper portion of the third embodiment.

Referring further to FIG. 4 there is shown an upper portion of the system of FIG. 3. The tubular liner section 8 is formed from flat metal sheet 36 wound on a reel 34. During use the flat metal sheet 36 is unwound from the reel 34, fed to the drill string 22 and bent around the drill string by means of a suitable bending device (not shown). The adjoining edges of the bent metal sheet 36 are then welded together to form the tubular liner section 8. An annular seal 40 is fixedly connected to the upper end of the expanded liner section 10 so as to seal the unexpanded liner section 8 relative to the expanded liner section 10, whereby the unexpanded liner section 8 is allowed to slide in axial direction relative to the seal 40. The expanded liner section 10 is at its upper end provided with a conduit 42 connected to a pump (not shown) for pumping fluid into the annular space 44 formed between the unexpanded liner section 8 and the expanded liner section 10.

Figure 5:
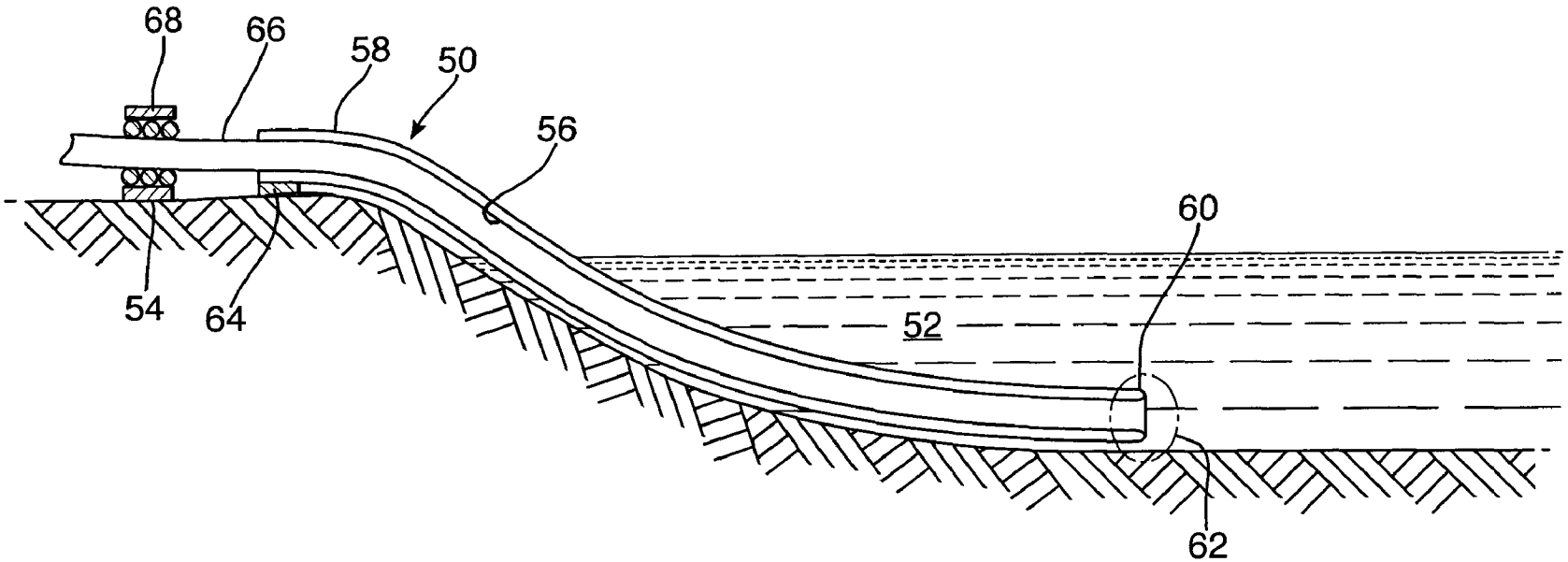
FIG. 5 schematically shows a pipeline system for use with the method of the invention.

Referring to FIG. 5 there is shown a pipeline 50 extending into a body of water 52, for example a sea or a river, from an onshore location 54. The pipeline 50 comprises an unexpanded pipe section 56 and an expanded pipe section 58 extending around the unexpanded pipe section 52. The wall of the unexpanded pipe section 56 bends, at its far end, radially outward and in axially reverse direction so as to form an end section 60 having a U-shaped wall, said end section 60 interconnecting the unexpanded section 56 and the expanded section 58. The end section 60 defines a bending zone 62 of the pipeline 50. The expanded pipe section 58 is anchored to the ground, at the onshore location 54, by a suitable anchoring device 64. Further, the unexpanded pipe section 56 has an end part 66 protruding from the expanded pipe section 58 at the onshore location 54. A tractor device 68 is arranged near the anchoring device 64, for pushing the unexpanded section 56 further into the expanded section 58.

During normal operation of the first embodiment (FIG. 1), the lower end portion of the wall of the yet unexpanded liner 4 is bent radially outward and in axially reverse direction by any suitable means so as to initiate forming of the U-shaped lower section 11. The radially outermost leg 10 of the U-shaped wall is then fixedly connected to the wellbore wall 12, which can occur automatically due to frictional forces between the leg 10 and the wellbore wall 12, or by any other suitable means.

A downward force F of sufficiently large magnitude is then applied to the unexpanded liner section 8 to move the unexpanded liner section 8 gradually downwardly. The wall of the unexpanded liner section 8 is thereby progressively bent and formed into the expanded liner section 10. As a result of such procedure, the bending zone 9 moves in downward direction at approximately half the speed of the unexpanded section 8. In a relative sense, the bending zone 9 moves upwardly relative to the unexpanded section 8. If desired, the diameter and/or wall thickness of the liner 4 can be selected such that the expanded liner section 10 becomes firmly compressed against the wellbore wall 12 as a result of the expansion process so as to create a seal between the expanded liner section 10 and the wellbore wall 12 and/or to stabilize the wellbore wall. Since the length, and hence the weight, of the unexpanded section 8 gradually increases, the downward force F can be lowered gradually in correspondence with the increased weight.

Optionally a heavy weight fluid or a pressurised can be pumped into the annular space between the unexpanded and expanded liner sections 8, 10 during or after the expansion process to reduce the collapse loading on the expanded section 10 or to reduce the burst loading on the unexpanded section 8.

Normal operation of the second embodiment (FIG. 2) is substantially similar to normal operation of the first embodiment (FIG. 1), however with the additional feature that the wall of the U-shaped lower section 11 is supported and guided by the guide surface 20 of guide member 14 so as to promote bending of the wall of the tubular element 4 in the bending zone 9. Furthermore, the guide ring 15 provides additional guidance to the wall in the bending zone 9 during the deformation process.

During normal operation of the third embodiment (FIGS. 3 and 4) the downhole motor 25 is operated to rotate the drill bit 26 so as to deepen the wellbore 24 by further drilling. The drill string 22 gradually moves deeper into the wellbore 24 as drilling proceeds. The unexpanded liner section 8 is formed at surface from the flat metal sheet 36 that is unwound from the reel 34 and bent around the drill string using any suitable bending device, whereafter the adjoining edges of the bent metal sheet 36 are welded together. Alternatively, the unexpanded liner section 8 can be assembled from pipe sections at surface, as is normal practice for tubular strings such as drill strings, casings or liners.

The U-shaped lower section 11 of the liner 8 rests on the guide surface 20 of the guide member 14 and moves further into the wellbore 24 simultaneously with the drill string 22. Thus, the U-shaped lower section 11 of liner 4 is continuously in contact with the guide surface 20 of the guide member 14. Initially the downward force F needs to be applied to the unexpanded liner section 8 to induce lowering thereof simultaneously with the drill string 22. However the length of the unexpanded liner section 8, and therefore also its weight, gradually increases so that the downward force F gradually can be decreased and eventually needs to be replaced by an upward force to control the speed of lowering of the unexpanded liner section 8. The weight of the unexpanded liner section 8, in combination with the force F (if any), also can be used to provide the necessary thrust force to the drill bit 26 during further drilling of the wellbore 24. In the embodiment of FIG. 3 such thrust force is transmitted to the drill bit 26 via the guide member 14 and the support ring 32. In an alternative application, the guide member 14 is dispensed with, and the thrust force is directly transmitted from the unexpanded liner section 8 to the drill string 22 or the drill bit 26, for example via suitable bearing means (not shown).

Thus, by gradually lowering the unexpanded liner section 8 into the wellbore, the lower end of the wall of the unexpanded liner section 8 is progressively bent in axially reverse direction, thereby progressively forming the expanded liner section 10. During the expansion process, the U-shaped lower section 11 is supported and guided by the guide surface 20 of guide member 14 so as to promote bending of the lower end of the wall of the unexpanded section 8. The guide ring 15 provides additional guidance to the wall during the expansion process.

When it is required to retrieve the drill string 22 to surface, for example when the drill bit is to be replaced or when drilling of the wellbore 24 is completed, the support shoulder 32 is radially retracted and the reamer bit 30 is brought to the collapsed mode. Thereafter the drill string 22 is retrieved through the unexpanded liner section 8 to surface. The guide member 14 can remain downhole. Alternatively, the guide member 14 can be made collapsible so as to allow it to be retrieved to surface in collapsed mode through the unexpanded liner section 8.

After the wellbore 24 has been drilled to the desired depth and the drill string 22 has been removed from the wellbore, the length of unexpanded liner section 8 still present in the wellbore 24 can be left in the wellbore 24, or it can be cut off from the expanded section 10 and retrieved to surface.

In case the length of unexpanded liner section 8 is left in the wellbore 24, there are several options for completion of the wellbore, such as:

a) a fluid, for example brine, is pumped into the annular space 44 via conduit 42 so as to pressurise the annular space 44 and thereby to increase the collapse resistance of the expanded liner section 10. Optionally, a hole can be provided in the wall of the liner near its lower end for circulation of the pumped fluid;

b) a heavy fluid is pumped into the annular space 44 via conduit 42 so as to support the expanded liner section 10 and increase its collapse resistance;

c) cement is pumped into the annular space 44 to create, after hardening of the cement, a solid body between the unexpanded liner section 8 and the expanded liner section 10. Suitably, the cement expands upon hardening;

d) the unexpanded liner section 8 is radially expanded against the expanded liner section 10, for example by pumping, pushing or pulling an expander (not shown) through the unexpanded liner section 8.

In the above example, expansion of the liner is started in the wellbore. However, in case the wellbore is located below the seabed whereby an offshore platform is situated above the wellbore, it can be advantageous to start the expansion process at the offshore platform. In such process the bending zone moves from the offshore platform to the seabed and from there into the wellbore. Thus, the resulting expanded tubular element not only forms a liner in the wellbore, but also forms a riser from the seabed to the offshore platform. The need for a separate riser from the seabed to the platform is thereby obviated.

Further, electric wires or optical fibres can be located in the annular space between the expanded and unexpanded sections for communication with downhole equipment. Such wires or fibres can be attached to the outer surface of the tubular element before expansion thereof. Also, the expanded and unexpanded sections can be used as electricity conductors to transfer data and/or power downhole.

Since the length of unexpanded liner section that is left in the wellbore does not need to be expanded, less stringent requirements regarding material properties etc. may apply to it. For example, said length may have a lower or higher yield strength, or a smaller or larger wall thickness than the expanded section.

Instead of leaving a length of unexpanded liner section in the wellbore after the expansion process, the entire liner can be expanded with the method of the invention so that no unexpanded liner section remains in the wellbore. In such case, an elongate member, for example a pipe string, can be used to exert the necessary downward force F to the unexpanded liner section during the last phase of the expansion process.

During normal operation of the system of FIG. 5, an end portion of the wall of the yet unexpanded pipeline 50 is bent radially outward and in axially reverse direction so as to initiate said U-shaped end section 60. The radially outermost leg of the U-shaped wall is then anchored to the ground by means of the anchoring device 64. Subsequently, the tractor device 68 is operated to move the unexpanded pipe section 56 gradually further into the expanded pipe section 58 that is formed by the bending process. The wall of the unexpanded pipe section 56 is thereby progressively bent and formed into the expanded pipe section 58. As a result, the bending zone 62 moves further into the body of water 52 at approximately half the speed at which the unexpanded section 56 is moved into the expanded section 58. The procedure is continued until the pipeline 50 has been moved sufficiently far into the body of water 52.

In order to reduce friction forces between the unexpanded and expanded tubular sections during the expansion process described in any of the aforementioned examples, suitably a friction reducing layer, such as a Teflon layer, is applied between the unexpanded and expanded tubular sections. For example, a friction reducing coating can be applied to the outer surface of the tubular element before expansion. Such layer of friction reducing material furthermore reduces the annular clearance between the unexpanded and expanded sections, thus resulting in a reduced buckling tendency of the unexpanded section. Instead of, or in addition to, such friction reducing layer, centralizing pads and/or rollers can be applied between the unexpanded and expanded sections to reduce the friction forces and the annular clearance there-between.

With the method described above it is achieved that, during the drilling process, there is only a relatively short open-hole section in the wellbore since the expanded liner section extends to near the lower end of the drill string at any time. The method therefore has many advantages. For example, longer intervals can be drilled without setting new casing sections, thereby leading to fewer casing sections of different diameters. Also, if the wellbore is drilled through a shale layer, the short open-hole section eliminates any problems due to a heaving tendency of the shale.

With the method of the invention, the expanded tubular section can extend from surface into the wellbore, or it can extend from a downhole location deeper into the wellbore.

In case the wellbore is an offshore wellbore whereby a drilling platform is positioned above the wellbore at the sea surface, the remaining (i.e. unexpanded) tubular section can extend from the drilling platform through the seawater into the wellbore. Thus, the remaining tubular section then forms an offshore riser, and no separate riser is needed for the drilling operation.

Instead of expanding the expanded liner section against the wellbore wall (as described above), the expanded liner section can be expanded against the inner surface of another tubular element already present in the wellbore.

Furthermore, instead of moving the unexpanded liner section downwardly through the wellbore, the unexpanded liner section can be moved upwardly through the wellbore during the expansion process. Although the examples described above refer to applications of the invention in a wellbore, it is to be understood that the method of the invention also can be applied at the earth surface. For example, the expanded liner section can be expanded against the inner surface of a pipe such as an existing flowline for the transportation of oil or gas located at the earth surface or at some depth below the surface. In this manner such existing flowline is provided with a new lining thereby obviating the need to replace the entire flowline in case it has deteriorated over time.

What is claimed is:

1. A method of radially expanding a tubular element extending into a wellbore formed in an earth formation, the method comprising inducing a wall of the tubular element to bend radially outward and in a longitudinal axial direction so as to form an expanded tubular section extending around a remaining tubular section of the tubular element, wherein said bending occurs in a bending zone of the tubular element;

increasing the length of the expanded tubular section by inducing the bending zone to move in a direction opposite the longitudinal axial direction relative to the remaining tubular section, wherein said wall includes a metal that is plastically deformed in the bending zone during the bending process so that the expanded tubular section retains an expanded shape as a result of said plastic deformation; the method further comprising the steps of:

axially fixing the expanded tubular section; and pushing the remaining tubular section into the expanded tubular section.

2. The method of claim 1, wherein the bending zone is induced to move in axial direction relative to the remaining tubular section by inducing the remaining tubular section to move in axial direction relative to the expanded tubular section.

3. The method of claim 2, wherein the remaining tubular section is subjected to an axially compressive force acting to induce said movement of the remaining tubular section.

4. The method of claim 3, wherein said axially compressive force is at least partly due to the weight of the remaining tubular section.

5. The method of claim 3, wherein said axially compressive force is at least partly due to an external force applied to the remaining tubular section.

6. The method of claim 1, wherein the remaining tubular section is axially shortened at a lower end thereof due to said movement of the bending zone, and wherein the method further comprises axially extending the remaining tubular section at an upper end thereof in correspondence with said axial shortening at the lower end thereof.

7. The method of claim 1, wherein an annular space is formed between the remaining tubular section and the expanded tubular section, the method further comprising inserting a pressurized fluid into the annular space.

8. The method of claim 1, wherein a drill string extends through the remaining tubular section for further drilling of the wellbore.

9. The method of claim 8, wherein the remaining tubular section and the drill string are simultaneously lowered through the wellbore during drilling with the drill string.

10. A method of radially expanding a tubular element extending into a wellbore formed in an earth formation, the method comprising:

inducing a wall of the tubular element to bend radially outward and in a longitudinal axial direction so as to form an expanded tubular section extending around a remaining tubular section of the tubular element, wherein said bending occurs in a bending zone of the tubular element;

increasing the length of the expanded tubular section by inducing the bending zone to move in a direction opposite the longitudinal axial direction relative to the remaining tubular section, wherein said wall includes a metal that is plastically deformed in the bending zone during the bending process so that the expanded tubular section retains an expanded shape as a result of said plastic deformation;

wherein a drill string extends through the remaining tubular section for further drilling of the wellbore wherein the remaining tubular section is formed from a metal sheet, and wherein the method comprises bending the metal sheet around the drill string at a surface location so as to form the remaining tubular section.

11. The method of claim 10, wherein the adjoining ends of the bent metal sheet are interconnected by welding.

12. The method of claim 10 wherein the expanded tubular section is compressed against one of the wellbore wall and another tubular element surrounding the expanded tubular section, as a result of said bending of the wall.

13. The method of claim 10 wherein the wall of the tubular element is guided during bending in the bending zone by a guide member having a radially extending guide surface located at or near the bending zone.

14. The method of claim 13, wherein at least a portion of the guide member extends into the unexpanded tubular section.

15. The method of claim 10 wherein an auxiliary guide member is arranged between the expanded tubular section and the remaining tubular section.

16. The method of claim 10 wherein a layer of friction reducing material extends between the expanded tubular section and the remaining tubular section.

17. The method of claim 16, wherein said layer of friction reducing material comprises a coating applied to the outer surface of the remaining tubular section.

18. A radially expanded tubular element obtained with the method of claim 10.

* * * * *